United States Patent [19]

Kaufman et al.

[11] Patent Number: 5,068,984

[45] Date of Patent: Dec. 3, 1991

[54] DOWNHILL SKI BOOT ASSEMBLY

[75] Inventors: William H. Kaufman; Frederick A. Harrison, both of Kitchener; Claude J. Gidman, Toronto; Gerald Beekenkamp, Paris, all of Canada

[73] Assignee: William H. Kaufman Inc., Kitchener, Ontario, Canada

[21] Appl. No.: 549,920

[22] Filed: Jul. 9, 1990

[51] Int. Cl.[5] ..... A43B 5/04

[52] U.S. Cl. ..... 36/117; 36/120

[58] Field of Search ..... 36/114, 117–121

[56] References Cited

U.S. PATENT DOCUMENTS

| | | | |
|---|---|---|---|
| 3,530,595 | 9/1970 | Vogel | 36/2.5 |
| 3,636,642 | 1/1972 | Walther | 36/2.5 |
| 3,713,231 | 1/1973 | Mochizuki | 36/121 |
| 3,747,235 | 7/1972 | Post | 36/2.5 |
| 3,793,747 | 2/1974 | Mochizuki | 36/121 |
| 3,854,743 | 12/1974 | Hansen | 280/11.35 K |
| 3,861,067 | 1/1975 | Koyama et al. | 36/2.5 |
| 3,984,124 | 10/1976 | Gertsch | 36/117 |
| 4,093,270 | 6/1978 | Krob et al. | 36/120 X |
| 4,367,885 | 1/1983 | Ramer | 36/121 |
| 4,473,235 | 9/1984 | Burt | 280/11.36 |
| 4,565,017 | 1/1986 | Ottieri | 36/121 X |
| 4,709,491 | 12/1987 | Morell et al. | 36/120 X |
| 4,959,912 | 10/1990 | Kaufman | 36/117 |
| 4,979,319 | 12/1990 | Hayes | 36/117 |

FOREIGN PATENT DOCUMENTS

| | | |
|---|---|---|
| 2718939 | 11/1978 | Fed. Rep. of Germany . |

*Primary Examiner*—David T. Fidei

*Attorney, Agent, or Firm*—Ridout & Maybee

[57] ABSTRACT

A downhill ski boot assembly combines a flexible walking boot with a boot brace insertable into a standard ski binding to provide a skier with the control and feel of a conventional hard ski boot. The boot brace has a sole plate insertable into the ski binding, and toe and heel hold down structures for the flexible boot are attached to the sole plate. Lower leg support is provided by the brace by means of upright supports which are preferably inner and outer lateral struts extending from the sole plate to a shin piece. The lower leg support has a spring biased pivot adjacent the ankle region which allows the skier to move his lower leg forward from the ankle against a biasing force.

11 Claims, 4 Drawing Sheets

DOWNHILL SKI BOOT ASSEMBLY

The invention is a ski boot assembly for a downhill ski and binding. The assembly comprises a boot brace for receiving and holding a soft boot in a conventional downhill ski binding. The boot brace enables the skier to control the ski in the normal way, and the soft boot allows the skier to walk normally when he is not skiing.

It is well recognized that the standard hard shell downhill ski boot is very awkward and uncomfortable to walk in. A number of prior attempts to utilize a reasonably comfortable soft walking boot in combination with support means for use in downhill skiing have suffered from serious shortcomings. Prior devices have predominantly attempted to provide control for the skier through the use of a strut or the like extending from the skier's calf either along the side of the leg or along the back of the leg to the ski binding. These prior devices usually did not provide the skier with a sufficient degree of control over the ski, or they were awkward to use, being cumbersome or complex to attach and adjust. Often the prior devices proved to be of insufficient strength to survive normal downhill skiing maneuvers or mishaps.

The present invention overcomes the disadvantages of prior devices and satisfies a long felt need for a ski boot assembly which may be used with a walking boot. Accordingly, the invention provides a downhill ski boot assembly comprising the combination of a boot brace and a flexible walking boot adapted to be held in the brace and to be releasable from it.

The boot brace has a rigid sole plate which is releasably securable in a downhill ski binding. Forefoot receiving means is attached to and extends over the forward portion of the sole plate. Preferably, the forefoot receiving means is a curved plastic molded toe cap into which the toe of the flexible boot can be inserted and held against substantial movement. A heel hold down means is connected to the rear portion of the sole plate which coacts with the heel structure of the boot to releasably hold the boot heel firmly against the sole plate. A preferred heel hold down means is a wire loop pivotally attached to the sole plate and which engages the heel of the boot by means of an over centre latch which coacts with a flange or slot formed in the boot.

The bracing structure of the boot brace of the invention comprises leg support means which extend upwardly from the sole plate to engage the leg shaft of the boot. The leg support means have a spring biased pivot adjacent the ankle region of the flexible boot positioned in the brace. Preferably, the leg support means comprise inner and outer lateral struts which extend upwardly from the sole plate to a curved shin piece which receives the leg shaft of the boot. Each strut is pivotally hinged approximately adjacent the skier's ankle so that the skier may pivot his leg forwardly from the ankle when skiing. The struts provide the required lateral support for the skier's leg so that he may exert a satisfactory degree of control over the ski during skiing. At least one of the pivot hinges in the struts is spring biased to provide an elastic resistance to the forward rotational force of the skier's lower leg. This resistance is akin to that provided by a standard ski boot. The spring biasing for the strut pivot is preferably provided by a rubber or other elastomeric spring unit which can be modified to fit the individual needs of the skier.

BRIEF DESCRIPTION OF THE DRAWINGS

As shown in FIG. 1, the preferred boot assembly of the invention comprises a boot brace 10 into which a flexible boot 12 may be releasably inserted. The boot 12 is specially designed to fit into the structure of the boot brace 10, but the boot 12 is not of a radically different construction than that of many ordinary winter boots. The boot 12 has a heel 13 which is specially structured to coact with the brace 10.

Figure 1:
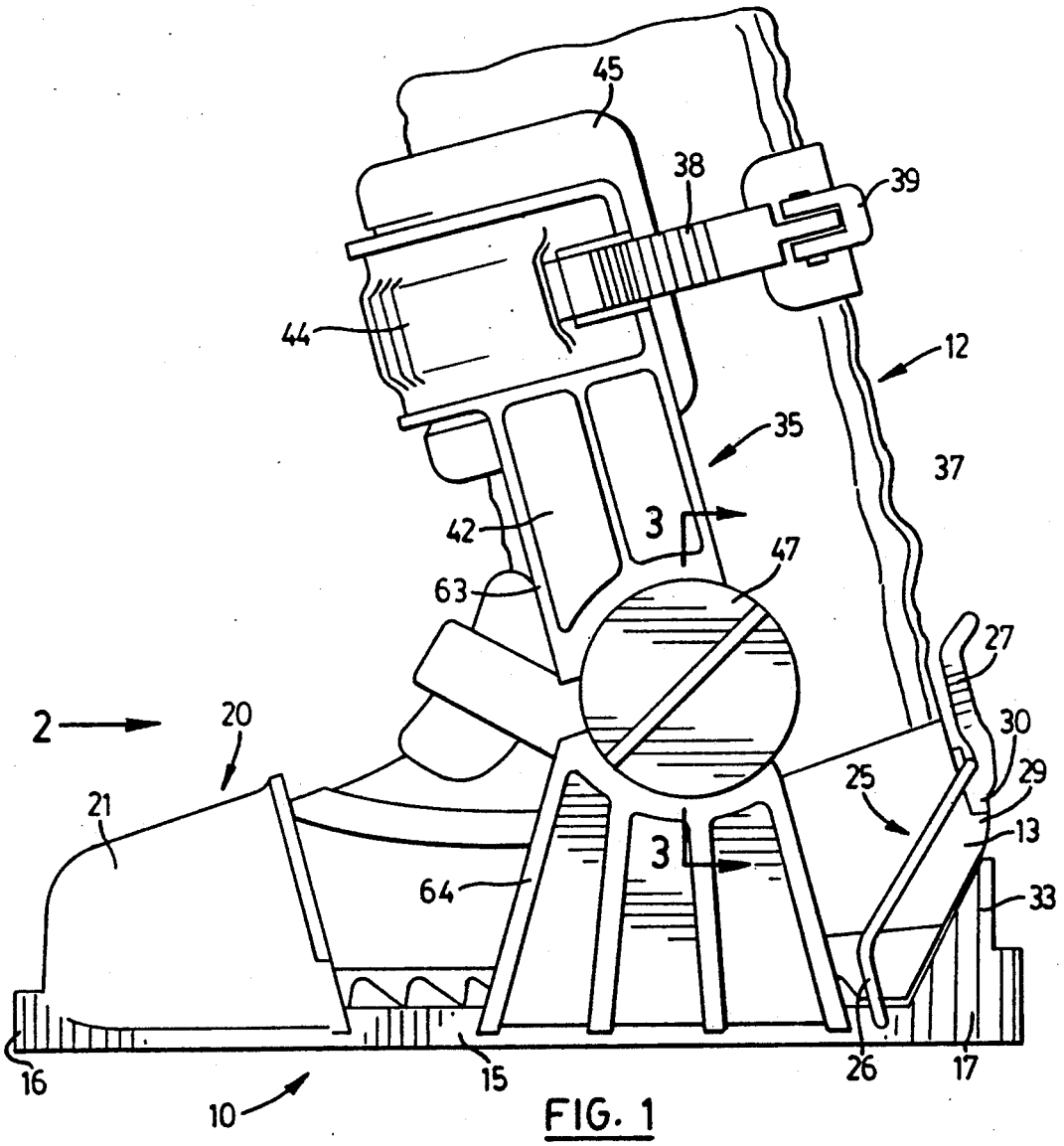
FIG. 1 is a side elevation of a preferred boot assembly of the invention.

The boot brace 10 has an elongate sole plate 15 which is preferably made of a moldable thermoplastic. The sole plate 15 has toe 16 and heel 17 portions shaped to fit into and to be releasably secured by a standard downhill ski binding.

A forefoot receiving means 20 for accepting and holding the toe portion of the boot 12 is attached to the forward portion of the sole plate 15. Preferably, the receiving means 20 is a curved toe cap 21 molded integrally with the sole plate 15. The purpose of the forefoot receiving means 20 is to provide a releasable securement of the toe portion of the boot 12 in the boot brace 10. It will be apparent to the skilled person that this objective may be achieved using various structures for the forefoot receiving means 20.

A heel hold down means 25 is provided at the rear portion of the sole plate 15 for releasably securing the heel 13 of the boot 12 in the boot brace 10. The preferred structure of the heel hold down means 25 comprises a wire loop 26 pivotally attached to the sole plate 15. The loop 26 has a latch 27, preferably of the eccentric or over centre type, which may engage a latch receiving structure 29 formed in the heel portion 13 of the boot 12. The latch receiving structure 29 may be a simple flange or notched area at the back of the boot 12 or a slot may be formed in the boot 12 into which a tongue 30 of the latch 27 may be inserted and secured. The wire loop 26 is shaped to hold the heel 13 of the boot 12 in the brace 10 under tension. Preferably, the heel portion 17 of the sole plate 15 has an upright heel stop 33 which is shaped to receive the boot heel 13 and prevent the boot 12 from moving rearwardly when secured in the brace 10. Other heel hold down means within the scope of the invention will be apparent to the skilled person.

An important aspect of a downhill ski boot is the ability of the boot to coact with the skier's leg as well as his foot to exert control over the ski. This leg control is provided by the stiffness of a conventional ski boot which extends along the skier's lower leg.

Figure 2:
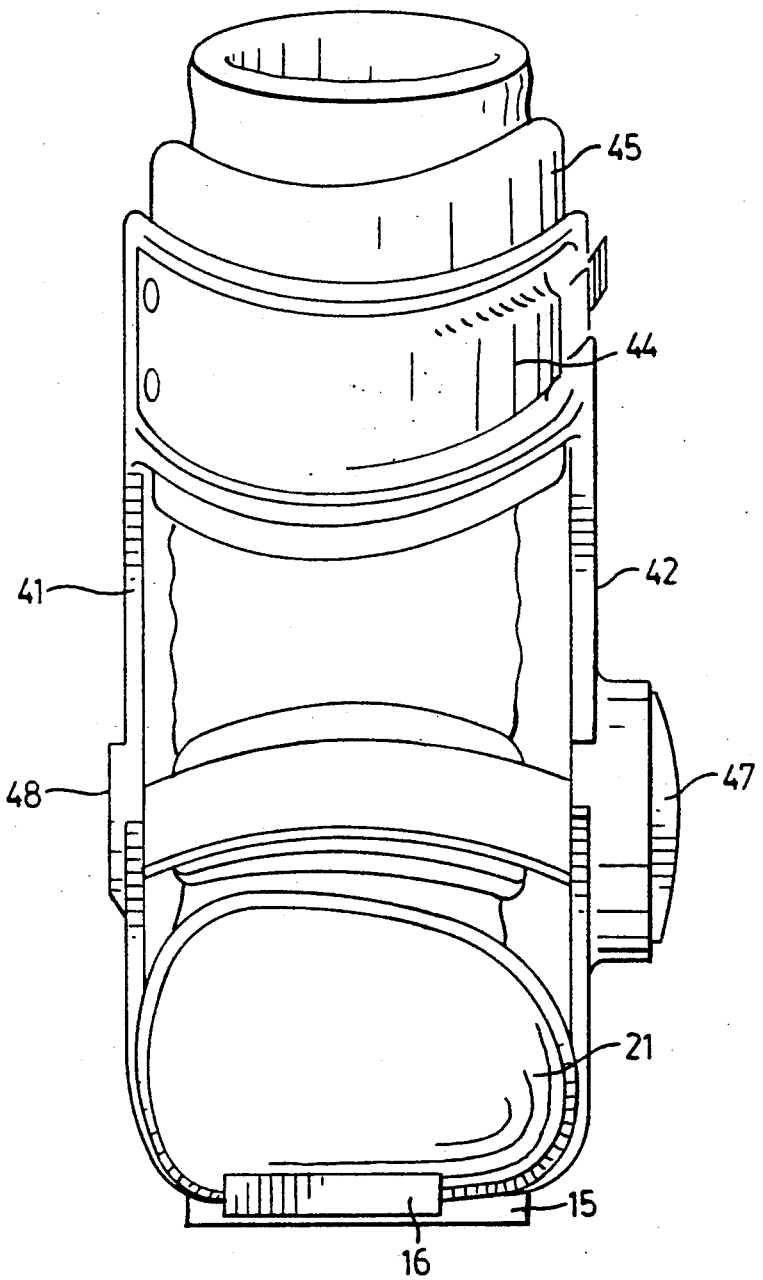
FIG. 2 is a front elevation of the assembly shown in FIG. 1.

The invention provides an ability, similar to that of a conventional ski boot, for the skier to exert control over the ski by moving his lower leg in relation to structural elements. In the preferred embodiment shown in FIGS. 1 and 2, these structural elements comprise leg support means 35 which extend upwardly from the sole plate 15 along the inner and outer sides of the boot 12. The leg support means 35 are releasably securable about the leg shaft 37 of the boot 12 preferably by means of a strap 38 and buckle 39. The leg support means 35 preferably comprise inner and outer lateral struts 41 and 42 which are attached at their lower ends to the sole plate 15, and at their upper ends are joined to a curved shin piece 44. The struts 41 and 42 and shin piece 44 are all made of a rigid material, preferably, a thermoplastic. Preferably, a pad 45 is provided along the inner surface of the shin piece 44 to cushion the skier's shin from the rigid shin piece 44. At least one strap 38 and a buckle 39 extend from the shin piece 44 to releasably secure it about the upper portion of the boot 12.

The leg support means 35 also has a spring biased pivot 47 adjacent the ankle region of the boot 12. This pivot 47 allows the skier to move his lower leg forward by bending at the ankle, thereby allowing the skier to readily adjust his weight over the ski during skiing. The spring biased pivot 47 provides forward resistance to the lower leg of the skier similar to that encountered in a conventional ski boot. While a spring biased pivot 47 may be incorporated into each strut 41 and 42, it is preferred to have such a pivot 47 in the outer strut 42 with the inner strut 41 having a non-biased pivot 48. A preferred spring biased pivot 47 is shown in FIGS. 3–6 and is of the rubber spring type.

Figure 3:
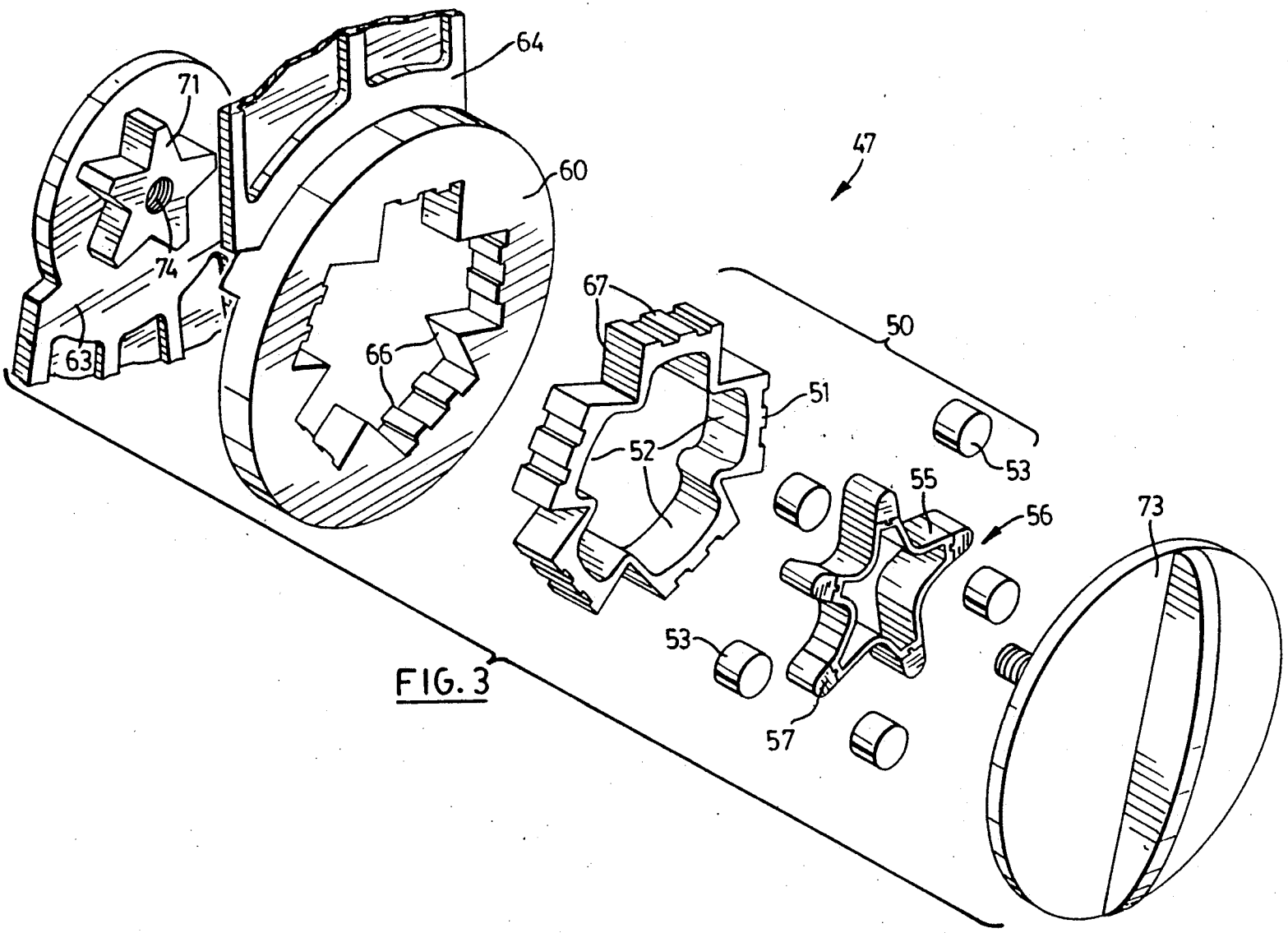
FIG. 3 is an exploded detail of a preferred spring biasing means for a strut pivot.

Referring to FIG. 3, the preferred spring biased pivot 47 comprises a cassette 50 having an outer frame 51 defining a plurality of inner spaces 52 shaped to receive an elastic member 53 and a movable part such as an arm 55 of an insert 56. While the star shaped insert 56 shown in FIGS. 3–6 is preferred, clearly the shapes of the rubber spring components may vary and still perform the same function.

The cassette 50 is securable against rotation of the frame 51 by insertion into a cassette holder 60 attached to a strut part 42. As shown in FIG. 3, the strut 42 is divided into an upper part 63 and a lower part 64 with the cassette holder 60 being attached to the lower part 64. The holder 60 preferably has a plurality of inner surfaces 66 which coact with corresponding outer surfaces 67 of the cassette frame 51. The holder 60 is structured to prevent rotation of the frame 51 but to allow the cassette 50 to be easily inserted or removed from it. Indexing means may be provided in the structure of the holder 60 to orient the cassette frame 51 in the holder 60 so that the upper strut part 63 is at a desired angle to the lower strut part 64 when the spring biased pivot 47 is assembled. For example, an expert skier may wish to have a more pronounced forward pitch for the strut 42 about the pivot 47 than would a novice skier, who would prefer a more upright feel for skiing on fairly gentle slopes.

An actuator 71 for the movable insert 56 is affixed to the other strut part 42, which according to the preferred embodiment shown in FIG. 3 is the upper part 63. The actuator 71 is shaped to fit within the insert 56 and to cause the arms 55 of the insert 56 to move against the elastic members 53 when the upper strut part 63 is rotated forwardly by the skier's leg pressure on the shin part 44. The operation of the spring biased pivot 47 is shown in FIGS. 4–6.

Figure 4:
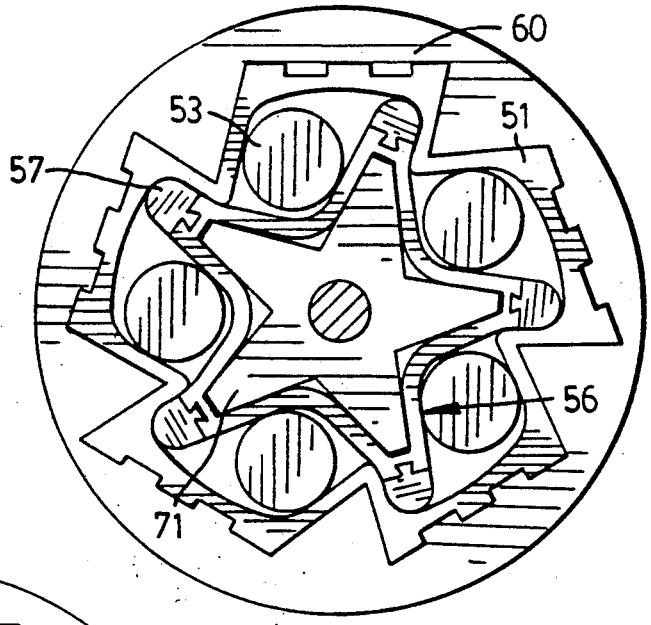
FIGS. 4–6 are side elevations of details of the preferred spring biasing means illustrating its operation.

In FIG. 4, the actuator 71 is exerting no rotational force on the insert 56, so the elastic members 53 are not compressed. In FIG. 5, forward leg pressure exerted by the skier on the shin part 44 has caused the actuator 71 to move the insert 56 so that the arms 55 of the insert 56 have begun to compress the elastic members 53. The elastic members 53 in turn exert a counter force on the insert 56 so that the skier experiences a spring resistance to his leg pressure. FIG. 6 shows near complete compression of the elastic members 53 by the rotational movement of the insert 56, thus representing the approximate limit of movement enabled by the structure.

Figure 5:
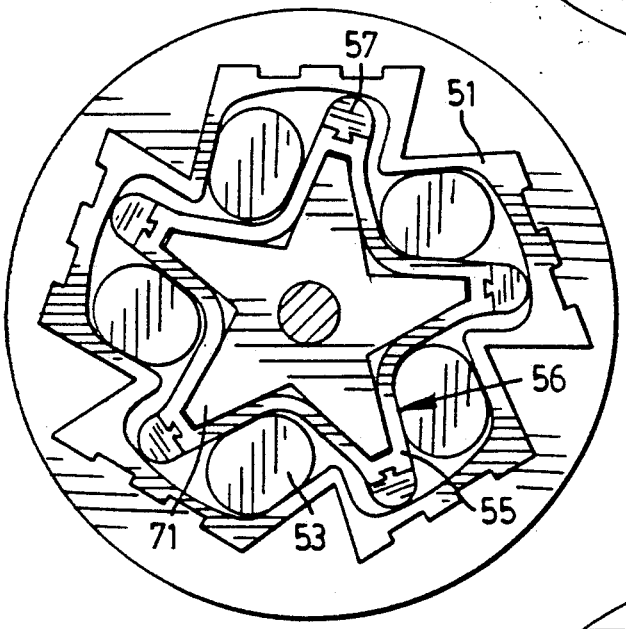
Figure 6:
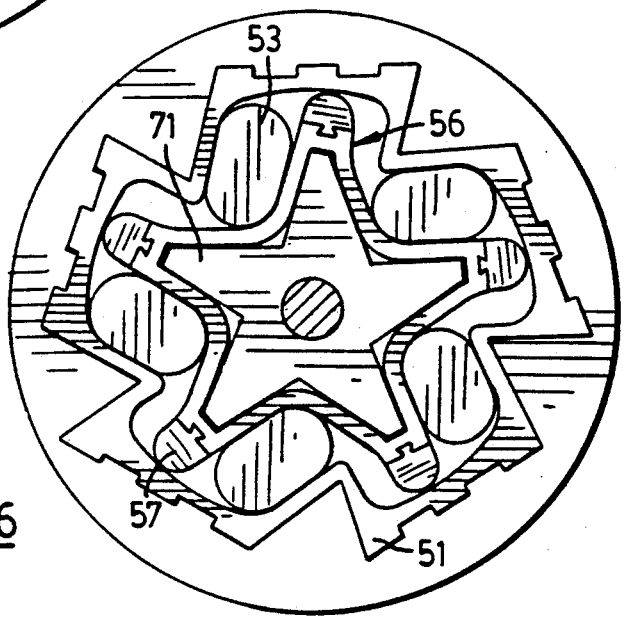

As shown in FIGS. 4–6, the arms 55 of the insert 56 preferably are provided with tips 57 to promote smooth movement of the insert 56 within the frame 51. Preferably, the frame 51 and insert 56 are made of a metal such as aluminum, and the tips 57 are then preferably of a plastic such as nylon.

The assembly of components for the spring biased pivot 47 is held together preferably by a cap screw 73 which is screwed into the threaded core 74 of the actuator 71. Clearly, various other means may be used to hold the components of the spring biased pivot 47 together during operation.

The preferred structure for the spring biased pivot 47 described herein has the advantage of employing a cassette 50 equipped with elastic members 53 tailored to the body weight and skiing needs of the individual skier. By varying the elastic properties of the rubber or other material used for the elastic members 53, the pivot 47 can be provided with the appropriate degree of biasing to suit the needs of the individual skier.

From the foregoing, it will be appreciated that the invention provides a ski boot assembly having structure which gives the skier the control and feel of a conventional ski boot but which incorporates a flexible boot so that the skier can remove his skis and walk normally and comfortably. While a preferred embodiment of the invention has been described, the ambit of patent protection sought is not intended to be limited by such description.

We claim:

1. A downhill ski boot assembly, comprising:

a boot brace having a sole plate adapted to be insertable into a downhill skiing binding; forefoot receiving means and heel hold down means connected to the sole plate for positioning and holding a boot against the sole plate; and inner and outer lateral leg support means extending upwardly from the sole plate and having a pivot including spring bias means at the ankle region adjacent the pivot to provide an elastic resistance to forward rotational motion; and a boot made of flexible materials enabling the wearer to walk normally, the boot being sized to fit in the boot brace, said boot having heel means adapted to coact with the heel hold down means and having a leg shaft about which the leg support means may engage.

2. A downhill ski boot assembly as claimed in claim 1, wherein the forefoot receiving means is a toe cap convexly curved over and attached to the sole plate, the toe cap and sole plate defining a space for receiving and holding the forefoot portion of the boot.

3. A downhill ski boot assembly as claimed in claim 1, wherein the heel hold down means is a wire loop pivotally attached to the sole plate, the loop having a latch for engaging a receiving structure formed in the heel portion of the boot.

4. A downhill ski boot assembly as claimed in claim 3, wherein the receiving structure in the heel portion of the boot is a flange and the latch is an over cente latch which coacts with the boot flange and wire loop to tension the rear portion of the boot against the sole plate.

5. A downhill ski boot assembly as claimed in claim 1, wherein the leg support means comprise an inner and an outer lateral strut each of which is attached to the sole plate and extends upwardly along the leg shaft of the boot to a forwardly convexly curved shin piece, the shin piece having a strap and buckle for releasably securing it about the upper portion of the boot.

6. A downhill ski boot assembly as claimed in claim 1, wherein the spring means for the leg support means comprises inner and outer parts which when juxtaposed have surfaces defining interior spaces for elastic members which compress upon rotation of the inner and outer parts relative to one another.

7. A downhill ski boot assembly as claimed in claim 1, wherein the spring means for the leg support means is a rubber spring.

8. A downhill ski boot assembly as claimed in claim 5, wherein the inner and outer struts are each divided into an upper and a lower portion about the ankle area of the boot, the inner strut portions are joined pivotally, and the outer strut portions are joined by the spring means.

9. A downhill ski boot assembly as claimed in claim 8, wherein the spring means is a rubber spring.

10. A downhill ski boot assembly as claimed in claim 8, wherein the spring means comprises: a cassette having an outer frame, elastic members, and a movable insert, the outer frame defining a plurality of spaces each shaped to receive a said elastic member and a part of the insert; a cassette holder fixedly attached to a strut portion, the holder allowing insertion and removal of the cassette but preventing rotation of it; and an actuator for the insert fixedly attached to the, other strut portion, the assembled spring means being held together by retaining means.

11. A downhill ski boot assembly as claimed in claim 10, wherein the elastic members are made of rubber, the cassette holder is attached to the lower strut portion, and the retaining means is a cap screw which coacts with a threaded core of the actuator.

* * * * *